US008712263B2

(12) United States Patent
Tanaka

(10) Patent No.: US 8,712,263 B2
(45) Date of Patent: Apr. 29, 2014

(54) IMAGE FORMING APPARATUS

(75) Inventor: Shigeru Tanaka, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 328 days.

(21) Appl. No.: 13/295,623

(22) Filed: Nov. 14, 2011

(65) Prior Publication Data

US 2012/0134690 A1 May 31, 2012

(30) Foreign Application Priority Data

Nov. 30, 2010 (JP) ..... 2010-266473

(51) Int. Cl.
*G03G 15/00* (2006.01)

(52) U.S. Cl.
USPC ..... 399/44; 399/53; 399/55

(58) Field of Classification Search
USPC ..... 399/9, 24–30, 38, 44, 46, 48, 53–55
See application file for complete search history.

(56) References Cited

U.S. PATENT DOCUMENTS

| | | | | |
|---|---|---|---|---|
| 4,027,621 | A | 6/1977 | Kane et al. | |
| 5,313,308 | A | 5/1994 | Hasegawa et al. | |
| 7,035,561 | B2 * | 4/2006 | Onishi | 399/55 |
| 7,792,456 | B2 | 9/2010 | Okamoto et al. | |
| 8,073,348 | B2 * | 12/2011 | Ozeki | 399/44 |
| 2009/0080926 | A1 | 3/2009 | Kurokawa | |
| 2009/0123166 | A1 | 5/2009 | Ozeki | |
| 2009/0136242 | A1 | 5/2009 | Okamoto et al. | |
| 2009/0214237 | A1 | 8/2009 | Ozeki | |
| 2011/0293300 | A1 | 12/2011 | Tanaka | |

FOREIGN PATENT DOCUMENTS

| | | | |
|---|---|---|---|
| CN | 101446797 | A | 6/2009 |
| GB | 1477985 | A | 6/1977 |
| JP | 63-177176 | A | 7/1988 |
| JP | 2-205873 | A | 8/1990 |
| JP | 4-114183 | A | 4/1992 |
| JP | 2808108 | B2 | 10/1998 |
| JP | 11-119503 | A | 4/1999 |
| JP | 2000-29295 | A | 1/2000 |
| JP | 2001-296706 | A | 10/2001 |
| JP | 2006-317889 | A | 11/2006 |
| JP | 2007-86314 | A | 4/2007 |
| JP | 2009-122444 | A | 6/2009 |
| JP | 2009-217067 | A | 9/2009 |

OTHER PUBLICATIONS

Combined Search and Examination Report Under Sections 17 and 18(3) dated Mar. 27, 2012, in Great Britain Application No. GB1120601.8.

Notification of the First Office Action dated Mar. 6, 2013, in Chinese Application No. 201110379001.8.

* cited by examiner

*Primary Examiner* — Hoan Tran

(74) *Attorney, Agent, or Firm* — Fitzpatrick, Cella, Harper & Scinto

(57) ABSTRACT

An image forming apparatus includes an image bearing member for carrying an electrostatic latent image; a developing device, containing a developer including a toner and a carrier, for developing the electrostatic latent image carried on the image bearing member into a toner image with the developer; a supplying device for supplying the toner to the developing device; a first detecting portion for detecting information on a temperature of the developing device; a second detecting portion for detecting information on a temperature of the supplying device; and a correcting portion for correcting, when detection results of the first and second detecting portions are different from each other, an image forming condition with increase of a supply amount of the supplying device.

11 Claims, 9 Drawing Sheets

IMAGE FORMING APPARATUS

FIELD OF THE INVENTION AND RELATED ART

The present invention relates to an image forming apparatus of an electrophotographic type. Specifically, the present invention relates to the image forming apparatus in which an image forming apparatus is corrected on the basis of humidity information about a developing device and a supplying device for supplying a developer to the developing device.

A proposed image forming apparatus intended to improve stability of an image density depending on temperature and humidity at inside and outside of the image forming apparatus was conventionally made. For example, as described in Japanese Patent No. 2808108, there is an image forming apparatus in which a history of humidity with a plurality of timings in a post predetermined time (period) is stored and a moisture absorption state of the developer is predicted in accordance with a plurality of stored data and then an image forming condition relating to the image density is controlled depending on the moisture absorption state.

Further, as described in Japanese Laid-Open Patent Application (JP-A) 2001-296706, there is an image forming apparatus in which a plurality of pieces of information such as an operating time of a developing device, a toner concentration, a toner supply amount and temperature and humidity at the periphery of the developer are inputted. Then, developing power of the developing device is comprehensively inferred and then a latent image forming condition, a toner supply condition, a charge imparting member for the developer, a developing bias condition and the like are controlled on the basis of the inferred result.

By using an image forming apparatus employing a dry two-component developing method, temperature and humidity of the developer were measured, when various image forming operations were performed, in the developing device or at respective portions of a toner supply container. As a result, when the temperature and humidity were different between the supply toner and the developer, it resulted that the temperature and humidity of the developer in the developing device had been changed. Further, it resulted that such a charge in temperature and humidity of the developer was larger with a larger amount of toner consumption and supply.

However, in the techniques described above in Japanese Patent No. 2808108 and JP-A 2001-296706, such a phenomenon was not assumed. For that reason, in a state in which the temperature and humidity of the supply toner and the developer are different from each other, when the image forming operation is performed, a charge amount of the toner subjected to development is different from an estimated charge amount, so that there is a possibility of a lowering in stability of the image density.

SUMMARY OF THE INVENTION

A principal object of the present invention is to provide an image forming apparatus capable of enhancing stability of an image density even when temperature and humidity of a supply toner and a developer contained in a developing device.

According to an aspect of the present invention, there is provided an image forming apparatus comprising:

an image bearing member for carrying an electrostatic latent image;

a developing device, containing a developer including a toner and a carrier, for developing the electrostatic latent image carried on the image bearing member into a toner image with the developer;

a supplying device for supplying the toner to the developing device;

a first detecting portion for detecting information on a temperature of the developing device;

a second detecting portion for detecting information on a temperature of the supplying device; and a correcting portion for correcting, when detection results of the first and second detecting portions are different from each other, an image forming condition with increase of a supply amount of the supplying device.

According to another aspect of the present invention, there is provided an image forming apparatus comprising:

an image bearing member for carrying an electrostatic latent image;

a developing device, containing a developer including a toner and a carrier, for developing the electrostatic latent image carried on the image bearing member into a toner image with the developer;

a supplying device for supplying the toner to the developing device; and a correcting portion for correcting, when temperatures in the developing device and in the supplying device are different from each other, an image forming condition with increase of a supply amount of the supplying device on the basis of information correlated with temperatures of the developing device and the supplying device.

According to a further aspect of the present invention, there is provided an image forming apparatus comprising:

an image bearing member for carrying an electrostatic latent image;

a developing device, containing a developer including a toner and a carrier, for developing the electrostatic latent image carried on the image bearing member into a toner image with the developer;

a supplying device for supplying the toner to the developing device;

a supply amount detecting portion for detecting information on a supply amount of the supplying device;

a calculating portion for calculating a temperature in the developing device and a temperature in the supplying device; and a correcting portion for correcting, when temperatures of the developing device and the supplying device are different from each other, an image forming condition with increase of a supply amount of the supplying device on the basis of information calculated by the calculating portion and on the basis of a detection result of the supply amount detecting portion.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS (First Embodiment)

Figure 1:
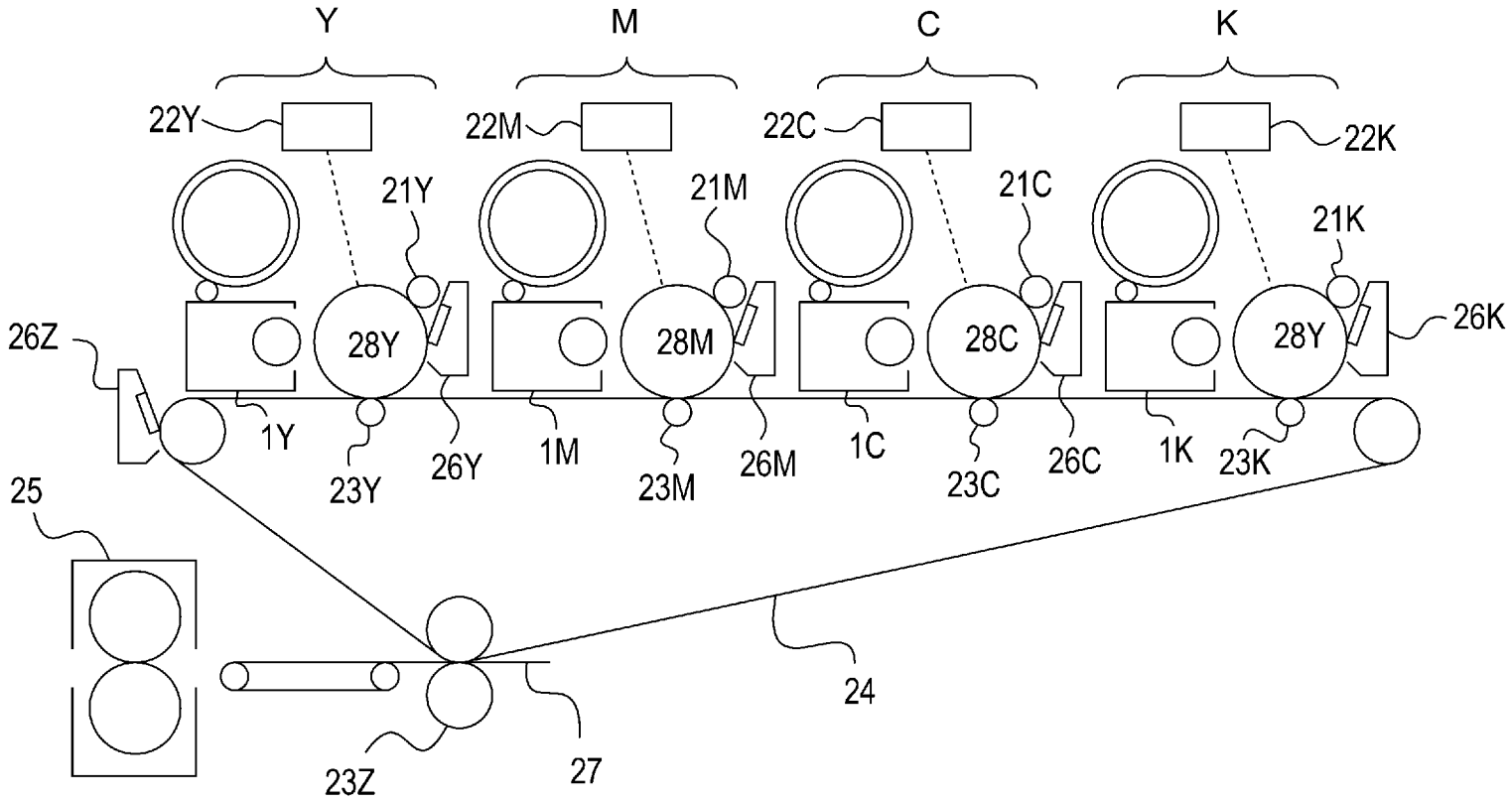
FIG. 1 is a structural view of an image forming apparatus in First Embodiment.

First Embodiment of an image forming apparatus to the present invention will be described with reference to the drawings. FIG. 1 is a structural view of the image forming apparatus in this embodiment. As shown in FIG. 1, the image forming apparatus in this embodiment is a so-called tandem type full-color image forming apparatus in which photosensitive drums (image bearing members) 28Y, 28M, 28C and 28K for yellow, magenta, cyan and black, respectively, are provided and juxtaposed.

The image forming apparatus forms toner images of respective colors at respective stations and superposes four color toner images on an intermediary transfer belt 24. Thereafter, the toner images are collectively secondary-transferred onto a sheet 27 by a secondary transfer roller 23*z*. The sheet 27 on which the toner images for the four colors are transferred is subjected to heating and pressurization by a fixing device 25, so that the toner images are fixed to provide a permanent image. Residual toner which is not transferred onto the sheet 27 is removed by an intermediary transfer belt cleaner 26*z*.

Figure 2:
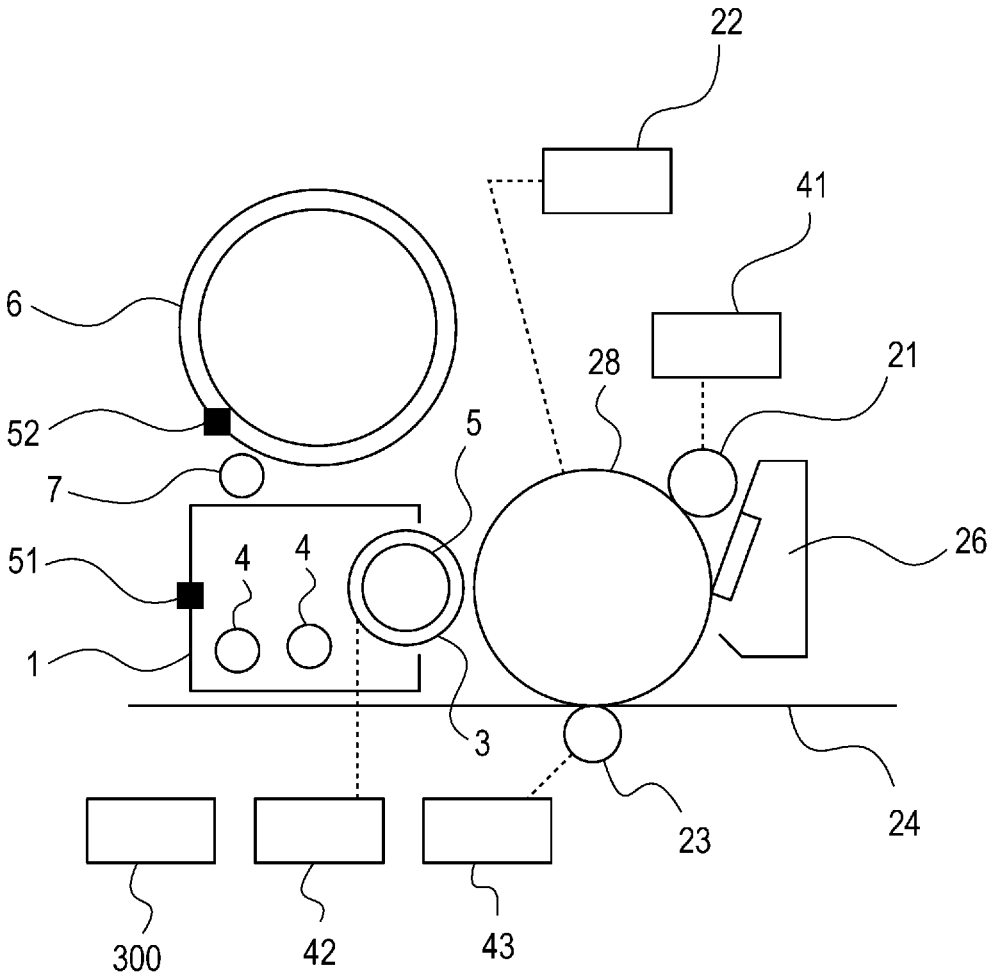
FIG. 2 is a structural view of each station of the image forming apparatus in First Embodiment.

FIG. 2 is a structural view of each station. The respective stations Y to K have the same constitution and therefore will be described by using numerals or symbols from which alphabetical suffixes are removed. As shown in FIG. 2, first, a surface of the photosensitive drum 28 is uniformly charged by a primary charger 21 to a white background portion potential Vd(V) by a charging bias applied from a charging bias voltage source 41. The charging bias is in the form of a DC component Vchg(V) biased with an AC component and in such an "AC charging method", the AC component is adjusted so that a value of Vchg(V) is substantially equal to Vd(V).

Next, on the basis of a signal corresponding to image data (image signal), a laser 22 is driven to irradiate the white background portion of the photosensitive drum 28 with a laser beam, so that an electrostatic latent image is formed. At a portion where maximum exposure is effected by the laser 22, the potential is a maximum density portion potential Vl(V).

The electrostatic latent image formed on the image bearing member is developed by a developing device 1, so that a toner image is obtained. The developing device 1 accommodates a two component developer containing at least a toner and a carrier and develops the electrostatic latent image, carried on the photosensitive drum 1, into the toner image with the two component developer. The respective color toner images are primary-transferred superposedly onto the intermediary transfer belt 24 by a primary transfer charger 23. Residual toner remaining on the photosensitive drum 28 after the primary transfer is removed by a cleaner 26.

Inside the developing device 1, a screw pair 4 provided so that two screws are disposed in parallel is rotated to feed the developer in mutually opposite directions perpendicular to the drawing sheet of FIG. 2, so that the developer is transferred at end portions of each of the screws extending in a direction perpendicular to the drawing sheet of FIG. 2, thus being circulated while being stirred. In this embodiment, a "two component developing method" In which a non-magnetic toner and a magnetic carrier are mixed and used as the developer is employed. At an opening of the developing device 1, a developing sleeve 3 is provided so as to oppose the photosensitive drum 28. The developing sleeve 3 is provided with a magnet 5 at its inside and carries the two component developer by a magnetic force to convey the two component developer to the surface of the photosensitive drum 28.

To the developing sleeve, a developing bias in the form of a predetermined DC component Vdev(V) biased with an AC component is applied from a developing bias voltage source 42. Here, with respect to the developing sleeve 3, a potential Vcont of the electrostatic latent image at a maximum density portion is an absolute value of Vl(V)−Vdev(V), i.e., Vcont=|VL−Vder|. Further, a potential difference Vback provided for preventing toner fog at the white background portion is an absolute value of Vd-Vdev, i.e., Vback=|Vd−Vdev|. Therefore, a latent image contrast (Vd−Vl) is represented by: Vl−Vd=Vcont+Vback.

When a maximum exposure amount is determined, Vl is uniquely determined with respect to Vd. That is, the latent image contrast can be adjusted by adjusting Vd, so that a predetermined relational expression is present therebetween. A printer controller 300 stores the predetermined relational expression and determines a proper Vd value (DC component Vchg of charging bias) from necessary values of Vcont and Vback. Further, a value obtained by subtracting the value of Vback from the value of Vd is the DC component Vdev of the developing bias.

Figure 3:
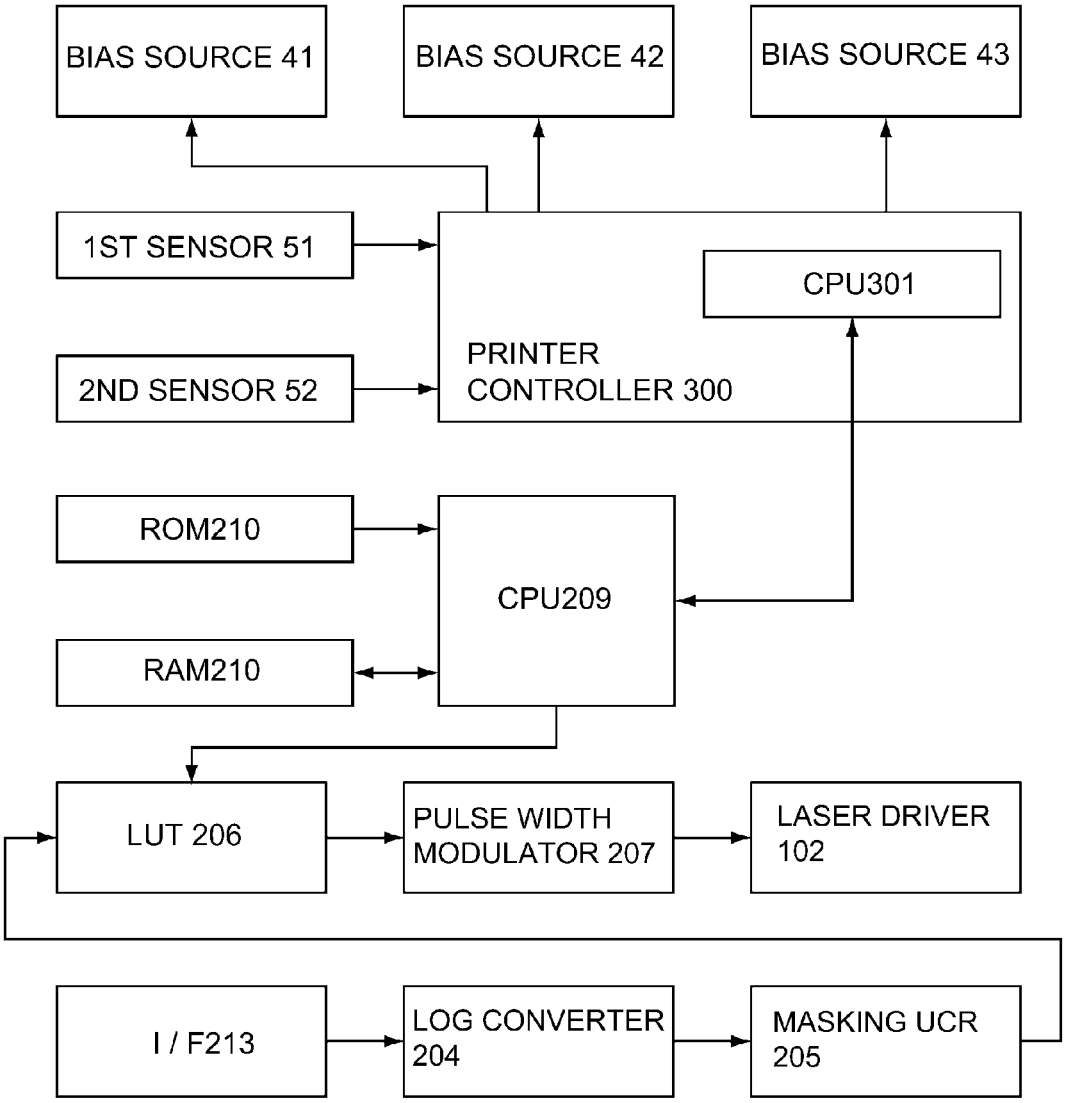
FIG. 3 is a block diagram showing a system constitution of the image forming apparatus.

As shown in FIGS. 2 and 3, each station includes, in order to apply the charging bias, the developing bias and a primary transfer bias, the charging bias voltage source 41 (Y, M, C, K), the developing bias voltage source 42 (Y, M, C, K) and a primary transfer bias voltage source 43 (Y, M, C, K). The printer controller 300 controls operations of the above-described respective portions of the image forming apparatus and operations of the bias voltage sources 41 to 43 by CPU 301 or the like incorporated therein.

Corresponding to the toner consumed by the toner image formation, a toner is supplied from a toner supply container (toner supplying means) 6 to the developing device 1. To the toner supply container 6, a screw 7 is rotatably provided and is rotationally driven to supply the toner in a predetermined to the developing device 1. The supply amount is determined by the printer controller 300 and is determined by the following parameters 1 to 3 and the like. The parameter 1 is a total exposure time of the laser 22 during printing. The parameter 2 is a value of a toner content (concentration) detecting sensor (not shown) for detecting toner content in the two component developer. The parameter 3 is a detection result of a toner image density detecting means (not shown) for detecting a deposition amount of a reference toner image obtained by developing a reference latent image.

Further, in FIGS. 1 and 3, a first temperature sensor (first temperature detecting means) (Y, K, C, K) is provided to the developing device 1 for each color and s a temperature detect T (Y, M, C, K) of the developing device 1 to provide notification to the printer controller 300. Similarly, a second temperature sensor (second temperature detecting means) 52 (Y, M, C, K) is provided to each toner supply container 6 for associated color and detects a temperature t (Y, K, C, K) of the toner supply container 6 to provide notification to the printer controller 300. Incidentally, it is preferable that the first temperature sensor 51 and the second temperature sensor 52 are disposed in the developing device 1 and the toner supply container 6, respectively, because they can most accurately measure the temperatures of the two component developer and the supply toner, respectively. However, in the case where there is a constraint on arrangement or a possibility of exchange of the developing device 1, the temperature sensors 51 and 52 may also be disposed in contact with or in the neighborhood of outer walls of the developing device 1 and the toner supply container 6, respectively, to measure approximate temperatures of the developing device 1 and the toner supply container 6, respectively.

Here, generally, in a state in which there is no coming and going of moisture (water content) in a closed space, the humidity is lowered with increase of a temperature. Further, a toner charge amount shows a strong correlation with the humidity. The toner charge amount is increased with a decrease in the humidity. Further, in the two component developing method, when the toner charge amount is increased, a deposition amount of the toner on the same latent image is decreased. For this reason, when a density of the image to be outputted is intended to be made constant, there is a need to largely adjust the maximum density portion potential Vcont of the electrostatic latent image (image forming condition) with respect to the developing sleeve 3.

On the other hand, the humidity is increased with a decrease in temperature, so that the toner charge amount is decreased, a deposition amount of the toner on the same latent image is increased. For this reason, when the image density is intended to be made constant, there is a need to make small adjustments of Vcont (image forming condition) with respect to the developing sleeve 3.

Further, as described above, when the temperature and humidity of the supply toner and those of the developer in the developing device 1 are different from each other, it resulted that the temperature and humidity of the developer in the developing device 1 are changed. Further, it has been turned out that such a change in temperature and humidity of the developer is larger with increase of an amount of toner consumption and supply.

When the above circumstances are taken into consideration, in the case where the supply toner temperature t (considered as being the same as the temperature t of the toner supply container t) is lower than the temperature T of the developing device 1, with supply of the supply toner, the supply toner with high humidity is supplied to the developing device 1 with low humidity. As a result, the humidity in the developing device 1 is increased, so that the image density is increased. Therefore, the image forming apparatus stabilizes the image density by decreasing the maximum density portion potential Vcont of the electrostatic latent image with respect to the developing sleeve 3.

Here, the adjustment amount of Vcont shows a correlation with a temperature difference between t and T and a supply toner amount r (g). That is, Vcont obtained by correcting standard Vcontenv on the basis of the formula (1):

$$V\text{cont}=V\text{contenv}+\alpha\times(t-T)\times r \quad (1).$$

A coefficient α is a positive value with a dimension (unit) of (V/g. ° C.) and is a value which should be adjusted for each image forming apparatus. In this embodiment, from an experiment result, α=2 (Vg. ° C.) was provided. The supply toner amount r (g) is (supply power: (g/sec) of toner supply container 6)×(toner supply time R (sec)). The toner supply time R is a parameter associated with the supply amount of the supply toner.

Figure 4:
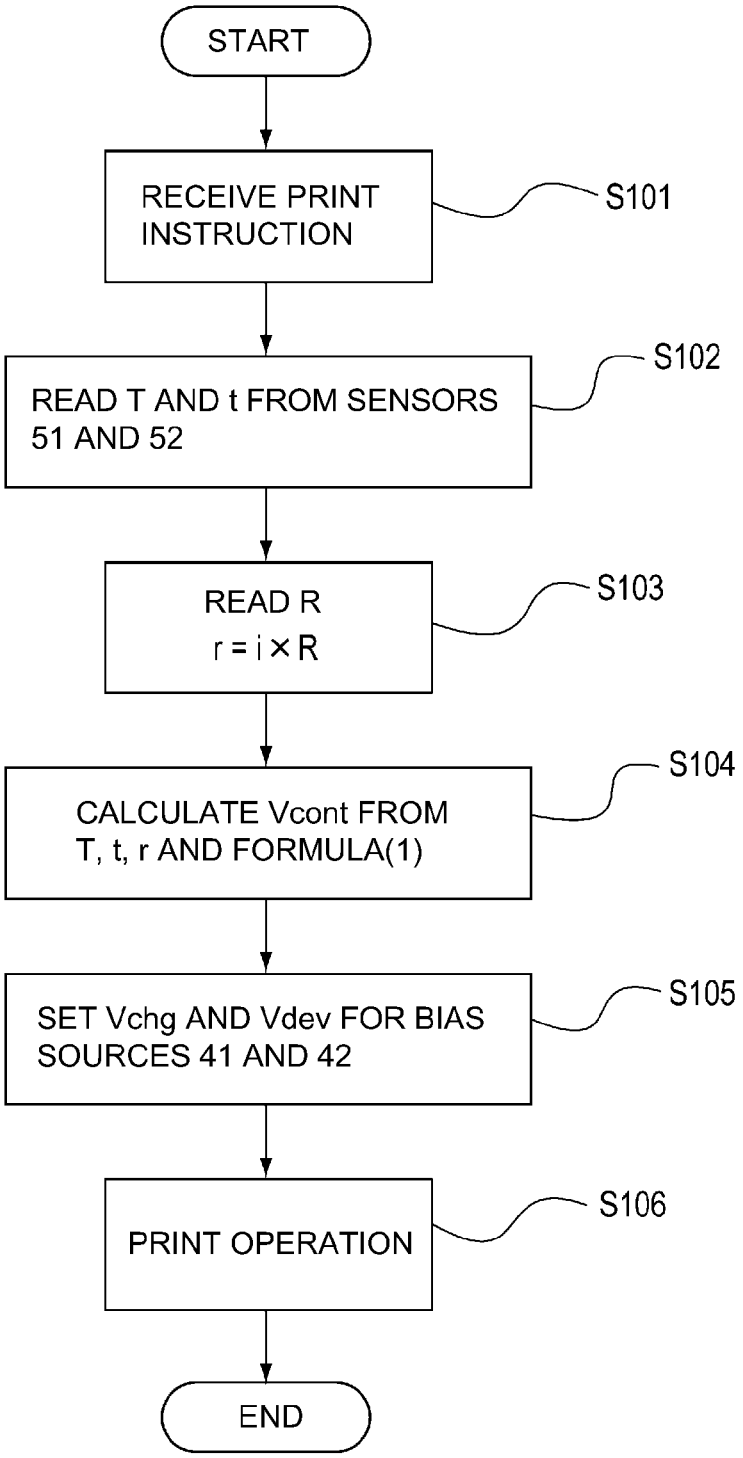
FIG. 4 is a flowchart for illustrating an operation of a printer controller 300 in First Embodiment.

FIG. 4 is a flowchart for illustrating an operation of the printer controller 300 in this embodiment. With reference to FIG. 4, control of the image forming apparatus by the printer controller 300 will be described. Here, a single image forming station is described and remaining image forming stations are omitted from description. Actually, the printer controller 300 performs the operations for the four (image forming) stations in parallel.

First, the printer controller 300 reads, when it receives a print (start) instruction (step S101), the temperature T of the developing device 1 and the temperature t of the toner supply container 6 are read from the first and second temperature sensors 51 and 52, respectively (step S102).

Next, the toner supply time R in preceding image formation has been stored in a memory of the printer controller 300 and therefore the printer controller 300 reads the value of R to determine r=i×R (step S103). Then, the printer controller 300 as a correcting portion calculates Vcont, corrected from the standard Vcontenv (200 V in this embodiment), from the values of T, t and r on the basis of the formula (I) described above (step S104).

For example, in the case of t<T, the coefficient α is the positive value as described above and thus the supply toner amount r naturally becomes a value of 0 or more. Therefore, Vcont is corrected so as to be a value of Vcontenv or less. On the other hand, in the case of t>T, Vcont is corrected so as to be a value of Vcontenv or more.

In this embodiment, a "negative-negative reverse development method" in which the development is effected by negatively charging both of the photosensitive drum 28 and the toner is employed and therefore the values of Vchg and Vdev are shifted toward a positive direction when Vcont is decreased and are shifted toward a negative direction when Vcont is increased. Shift amounts of the values of Vchg and Vdev are determined on the basis of a predetermined table stored in the printer controller 300 and are set for the charging bias voltage source 41 and the developing bias voltage source 42 (step S105). Thereafter, the printer controller 300 performs a printing operation to output an image (step S106).

By following the above-described flow, even in the case where the temperature of the developing device 1 (the developer in the developing device 1) and the temperature of the toner supply container 6 (the supply toner) are different from each other, it is possible to enhance stability of the image density of the outputted image.

1(Second Embodiment)

Figure 5:
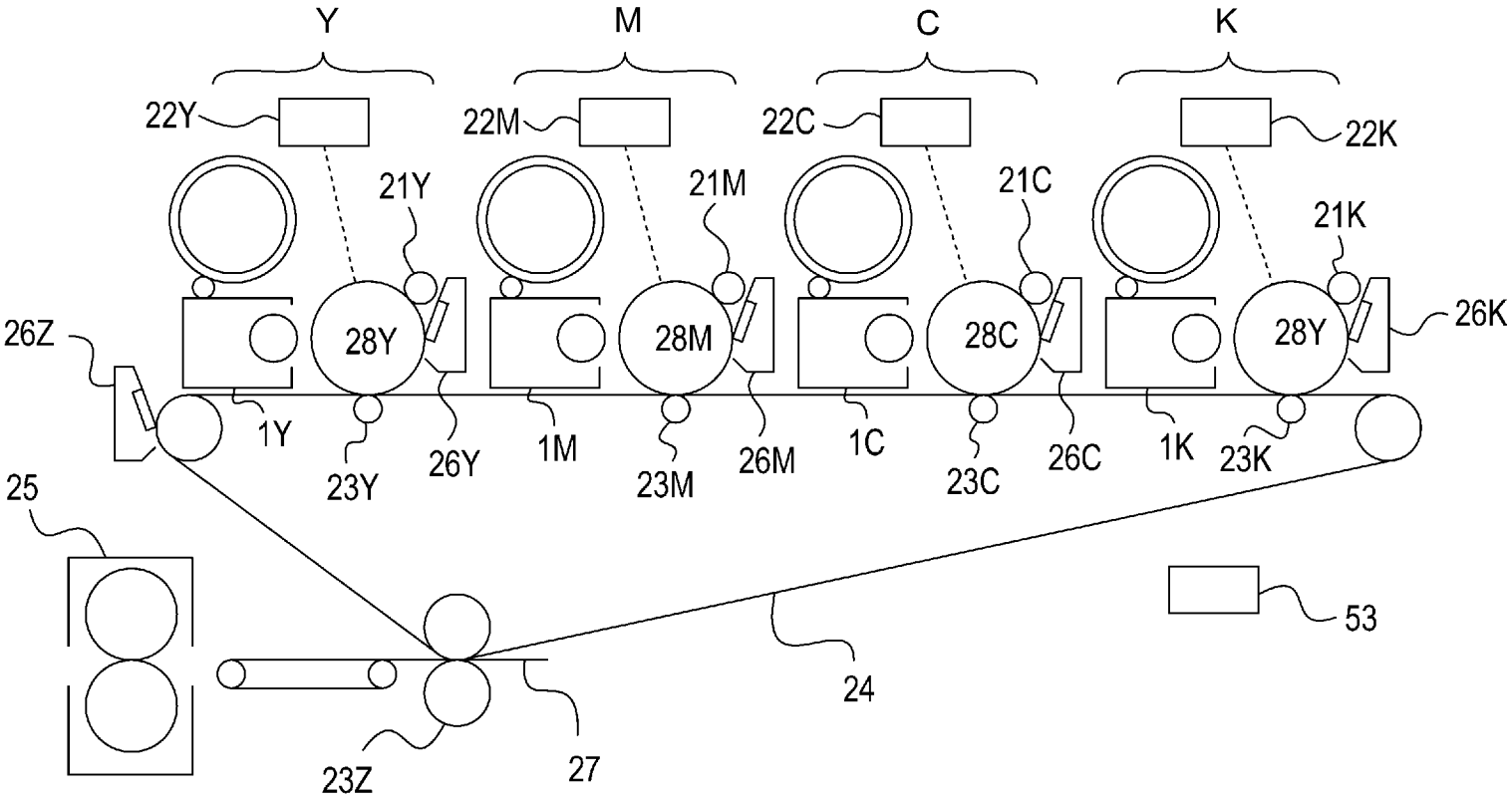
FIG. 5 is a schematic view for illustrating an image forming apparatus in Second Embodiment.

Next, Second Embodiment of an image forming apparatus according to the present invention will be described with reference to the drawings. A portion with redundancy in description with respect to that in First Embodiment will be omitted from the description by adding the same reference numerals or symbols. FIG. 5 is a schematic view for illustrating the image forming apparatus in this embodiment. A large difference between this embodiment and First 1 is that the temperatures of the developing device and the supplying device are measured in First Embodiment but in this embodiment, humidity information is detected and then the image forming condition is corrected. This will be described specifically below.

As shown in FIG. 5, the image forming apparatus in this embodiment is prepared by providing a temperature and humidity sensor (temperature and humidity detecting means) 53 to the image forming apparatus in First Embodiment. The temperature and humidity sensor 53 detects the temperature and humidity in the image forming apparatus or at a periphery of the image forming apparatus. Further, the image forming apparatus in this embodiment uses, as the parameter associated with the toner supply amount, an image duty value described later.

As shown in FIG. 3, a color image data as RGB image data are inputted, as desired, from an unshown external device such as an original scanner or a computer (information processing apparatus) through an external input interface (I/F) 213. An LOG converter 204 converts luminance (brightness) data of the inputted RGB image data into density data of cyan (C), magenta (M) and yellow (C) (CMY image data) on the basis of a γ LUT (look-up table) constituted by data stored in ROM 210. A masking/UCR portion 205 extracts component data for black (K) from CMY image data and performs matrix operation in order to correct color turbidity of a colorants for recording, thus obtaining CMYK image data. A look-up table portion (LUT portion) 206 subjects the inputted CMYK image data to density correction every color by using γ look-up table so that the image data match an ideal gradation characteristic of the printer portion. Incidentally, the γ LUT is prepared on the basis of data developed on RAM 211 and contents thereof are set by a CPU 209. A pulse width modulating portion 207 outputs a pulse signal with a pulse width corresponding to a level of the image data (image signal) inputted from the LUT portion 206. On the basis of this pulse signal, a laser driver 102 drives the laser 22, so as to change a total exposure time, to irradiate the white background portion of the photosensitive drum 28 with laser light, so that the electrostatic latent image with smooth gradation levels is formed.

Figure 6:
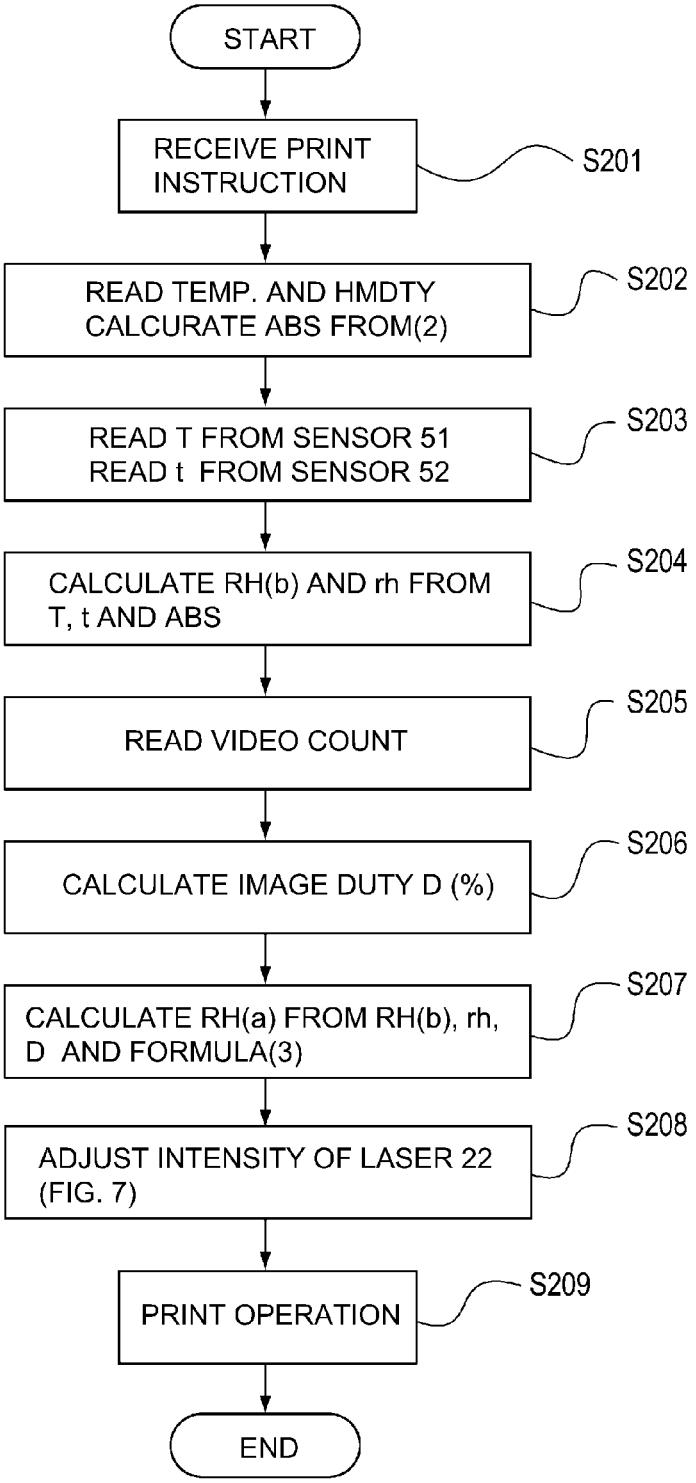
FIG. 6 is a flowchart for illustrating an operation of a printer controller 300 in Second Embodiment.

FIG. 6 is a flowchart for illustrating an operation of the printer controller 300 in this embodiment. With reference to FIG. 6, control of the image forming apparatus by the printer controller 300 in this embodiment will be described.

First, the printer controller 300 reads, when it receives a print (start) instruction (step S201), values of a temperature and a relative humidity are obtained from the temperature and humidity sensor 53 in the main assembly of the image forming apparatus and from these values, an absolute water (moisture) content ABS is obtained (step S202).

Herein, the absolute water content ABS is obtained in the following manner in accordance with an equation of state between saturated aqueous (water) vapor ressure and an ideal gas. First, the image forming apparatus of the present invention is used in an environment of almost 1 atmospheric pressure and a temperature of about 0° C. to about 60° C. For this reason, a saturated aqueous vapor pressure (Pa) at a temperature τ (° C.) is obtained from Tetens's approximation (2):

$$E(\tau)=611\times10(7.5\times\tau/(\tau+237.3)) \quad (2),$$

wherein E represents the saturated aqueous vapor pressure (Pa) and τ represents Celsius degree (centigrade temperature).

Next, in accordance with the equation of state of the ideal gas, a saturated absolute water content (volume absolute humidity) is obtained from the formula (3):

$$ABS\ (\mathrm{g/m^3})=2.17\times E(\tau)/(\tau+273.15) \quad (3).$$

The absolute water content (volume absolute humidity) ABS ($\mathrm{g/m^3}$) is obtained by multiplying this value by the value of the relative humidity.

Then, the printer controller 300 obtains a measured temperature value T (developing device toner) by the first temperature sensor 51 and a measured temperature value t (toner supply container temperature) by the second temperature sensor 52 (step S203). Thereafter, from these values and the absolute water content ABS, a relative humidity RH(b) of the developer in the developing device 1 and a relative humidity RH of the toner in the toner supply container 6 are calculated (step S204).

The CPU 301 in the printer controller 300 cooperates with CPU 209 of an image processing unit. In the memory of the printer controller 300, an integrated value (video count value) of the CMYK image data for each pixel at a stage immediately input into the LUT portion 206 in the previous printing operation. Here, the printer controller 300 reads out the video count value (step S205) and the value is divided by the video count value when the image data is a maximum (255 for 8 bit) at all the pixels. As a result, compared with the case of a whole surface maximum density, an image duty value D (%) which is a print density corresponding to the image is obtained (step S206).

When the relative humidity RH(b) of the developer in the developing device 1, the relative humidity RH of the toner in the toner supply container 6 and the image duty value D are obtained, then the printer controller 300 obtains a humidity RH(a) of the developer in the developing device 1 after the toner supply by the following formula (4) (step S207).

$$RH(a)=RH(b)+\beta\times(rh-RH(b))\times D \quad (4)$$

Here, a coefficient β is a positive value with no dimension, and a difference between RH(b) and RH is a value indicating that the difference is reflected on the developer in the developing device 1 to what degree. The coefficient β can be determined by the total developer amount, the print number corresponding to one circulation of the developer, the toner density value of the developer and the toner consumption at D=100%. In the case of this embodiment, the developer amount of each developing device 1 is 500 g and the print number for the developer circulation is 40 sheets and therefore the amount of the developer used per one print sheet is calculated as 500 g/40 sheets, i.e., 12.5 g (/sheet). By multiplying 12.5 g by the initial toner density of 8%, the amount of the toner subjected to development per one print sheet is obtained as 1 g. Further, the toner consumption at D=100% is 0.4 g and therefore β=0.4 g/1 g=0.4 is obtained.

Figure 7:
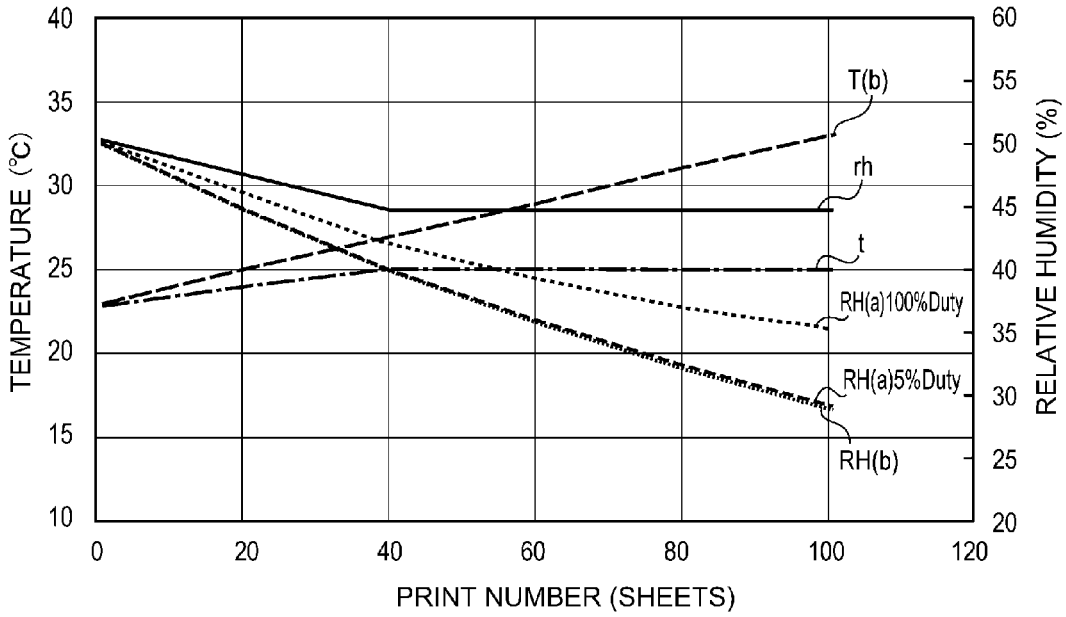
FIG. 7 is a graph showing an example of calculation values obtained by a formula (4) in Second Embodiment.

FIG. 7 is a graph showing an example of a calculation value obtained specifically by the formula (4). In FIG. 7, an abscissa represents the print number (sheets), an ordinate at left side represents the temperature (° C.) including the temperature T (T(b)) of the developing device 1 and the temperature t of the toner supply container 6, and an ordinate on right side represents the relative humidity (%) including RH(b), rh, RH(a) at D=5% and RH(a) at D=100%.

FIG. 7 is the calculation example such that an ambient environment is 23° C. and 50% RH, i.e., the absolute water content of 10.3 g/kg (dry air) and the temperatures T and t are gradually increased.

The developing device 1 is located in the neighborhood of the central portion of the image forming apparatus and therefore the temperature T of the developing device 1 is estimated as being increased depending on the print number. On the other hand, the toner supply container 6 is disposed at a relatively peripheral portion of the image forming apparatus and therefore a degree of the increase of a temperature t of the toner supply container 6 is estimated as being relatively slow. Under this condition, when RH(b) and RH are calculated, the result is as shown in FIG. 7. Further, the calculation result of RH(a) according to the formula (4) in the case where the image duty value D is 5% and 100% is shown in FIG. 7. In the case of D=5%, RH(a) is substantially equal to RH(b) but in the case of D=100%, RH(a) largely approaches RH side, so that it is understood that the humidity is increased.

Thus, in the case where the humidity of the toner supply container 6 is higher than the humidity of the developing device 1, the humidity of the developer is increased by the toner supply, so that the developing characteristic is changed in a direction in which the density is increased. In order to suppress this change, i.e., in order to make correction correspondingly to the increase of the density, the correction is made in a direction in which Vcont is decreased. On the other hand, when the humidity of the toner supply container 6 is lower than the humidity of the developing device 1, in order to make correction correspondingly to the decrease in density, the correction is made in a direction in which Vcont is increased.

Figure 8:
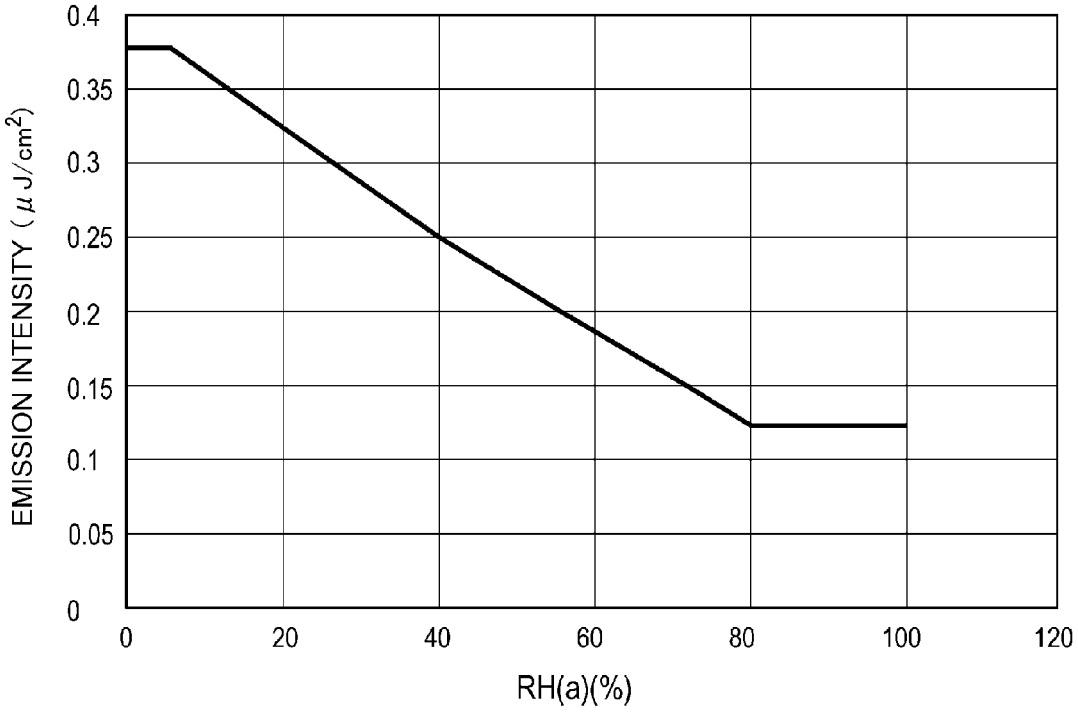
FIG. 8 is a graph showing a humidity RH(a) of a developer in a developing device and corresponding exposure intensity.

In this embodiment, the printer controller 300 adjusts emission intensity of the laser 22 to fluctuate Vcont (step S208). That is, the printer controller 300 calculates exposure intensity corresponding to RH(a) on the basis of a reference table shown in FIG. 8 and sets the calculated RH(a) for the laser driver 102. FIG. 8 is a table (graph) in which the abscissa represents RH(a) (%) and the ordinate represents exposure intensity ($\mu J/cm^2$) of the laser 22 corresponding to RH(a) (%) on the abscissa. The exposure intensity is a value at the surface of the photosensitive drum 28. This table is stored in ROM in the printer controller 300.

Thus, after the image forming condition is set, the printer controller 300 performs an actual printing operation. According to this embodiment, by using the detected values of the temperature and humidity sensor 53 for detecting the temperature and humidity in the image forming apparatus or at the peripheral of the image forming apparatus, in addition to the effect of First Embodiment described above, the humidity of the developer in the developing device can be reflected in the image forming condition with high accuracy and therefore stability of the image density can be maintained. Even in the case where the humidity of the developing device 1 and the humidity of the toner supply container 6 are different from each other due to temperature changes of the developing device 1 and toner supply container 6, respectively, it is possible to achieve stabilization of the image density.

(Third Embodiment)

Figure 9:
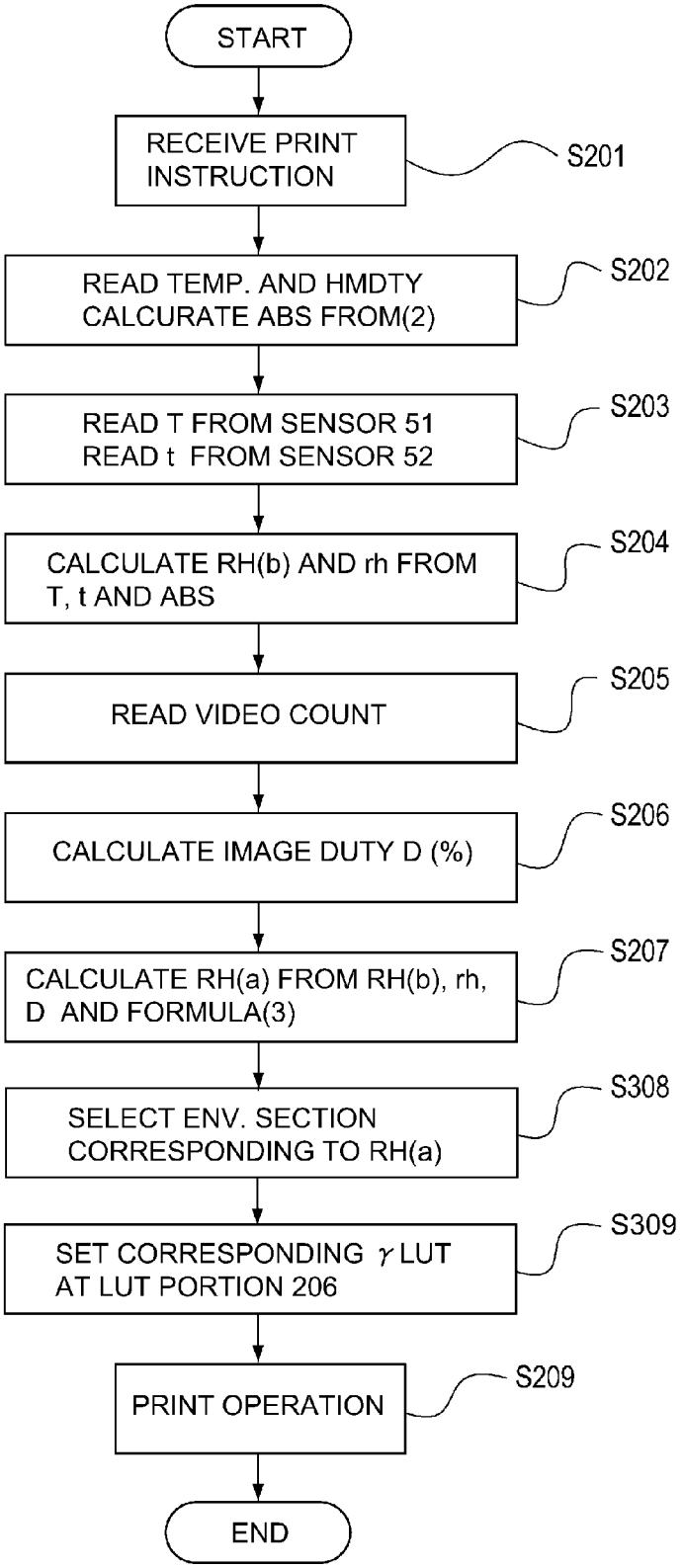
FIG. 9 is a flowchart for illustrating an operation of a printer controller 300 in Third Embodiment.

Next, Second Embodiment of an image forming apparatus according to the present invention will be described with reference to the drawings. A portion with redundancy in description with respect to that in First Embodiment will be omitted from the description by adding the same reference numerals or symbols. FIG. 9 is a flow chart for illustrating an operation of the printer controller 300 in this embodiment.

As shown in FIG. 9, in the image forming apparatus in this embodiment, in place of the step S208, in the image forming apparatus in First Embodiment, steps S308 and S309 are provided. That is, in the image forming apparatus in this embodiment, as the image forming condition controlled on the basis of the humidity RH(a), γ LUT (look-up table) is selected (steps S308 and S309).

In this embodiment, environment sections are provided in areas at 8 levels each corresponding to an associated value of RH(a). In ROM 210, 8 γ LUTs corresponding to a first environment section to an eighth environmental section are stored and are developed appropriately at the LUT portion 206 in accordance with an instruction from the CPU 209. γ LUT describes that an output product of the image forming apparatus can obtain a desired density gradation level when laser light exposure with what pulse width is effected with respect to an inputted image signal, and is a table for determining 256 levels of the pulse width, at a pulse width modulating portion 207, as an output for inputted 256 levels of the image signal.

In this embodiment, the printer controller 300 selects a suitable environmental section from RH(a), of the developer in the developing device 1 after the toner supply, calculated in the step S207 and sends information on the selected environmental section to the CPU 209 (step S308). The CPU 209 reads, on the basis of the information, one proper γ LUT from the 8 γ LUTs corresponding to the pieces of the information, respectively, and sets the content at the LUT portion 206 (step S309). Specifically, in the case where the density is lowered, a slope of γ LUT is increased. On the other hand, in the case where the density is increased, γ LUT with a small slope is selected. Thereafter, the printer controller 300 performs the actual printing operation (step 209).

According to this embodiment, in addition to the effect of First Embodiment, by using the parameter associated with the supply amount of the supply toner, the humidity change of the developer in the developing device can be reflected in the image forming condition with accuracy and therefore the image density stability can be maintained.

Incidentally, in this embodiment, a method in which the γ LUTs in the environmental sections are prepared, respectively and then the proper γ LUT is selected is employed, but the number of the γ LUTs to be stored is decreased for reducing the capacity of ROM and the γ LUTs may also be changed by multiplying a predetermined ratio or by changing a difference therebetween.

(Fourth Embodiment)

A principal constitution in this embodiment is the same as that in Second Embodiment but a difference is that the second temperature sensor 52 is omitted and the toner supply container temperature t is obtained by being estimated from a measured temperature value τ of the temperature and humidity sensor 53 and an operation state of the image forming apparatus.

First, a general temperature estimation method will be described.

With respect to the temperature t of the toner supply container 6, when the ambient temperature is τ and temperatures of n heat sources in the neighborhood of the toner supply container 6 are $T_1, T_2, \ldots T_n$, a time change of the temperature t with a time s (sec) can be represented by the following differential equation (5).

$$d(t-\tau)/ds=-(t-\tau)/C_\tau$$

$$d(t-T_1)/ds=-(t-T_1)/C_1$$

$$d(t-T_2)/ds=-(t-T_2)/C_2$$

$$d(t-T_n)/ds=-(t-T_n)/Cn \quad (5)$$

Here, $C_\tau$, $C_1$, $C_2 \ldots C_n$ are constants determined by distances and heat capacity values between the toner supply container 6 and the outside air or heat sources 1, 2 . . . n. The differential equation (5) is an n-th degree equation and therefore cannot be solved in genera. For this reason, the equation (5) is replaced with a difference equation using a sufficiently small time Δs in place of ds and the respective equations are successively solved, so that the temperature t can be obtained. As examples of the heat sources, it would be considered that the developing device 1, the laser 22, the photosensitive drum 28, the fixing device 25 and the like are used. Further, the constant $C_\tau$ determined between the toner supply container 6 and the outside air is influenced by the arrangement and shape of the toner supply container 6 and th flow of air in the image forming apparatus. Further, of the heat sources, with respect to the developing device 1, the laser 22, the photosensitive drum 28 or the like, tendency and magnitude of the temperature increase and decrease are principally determined by drive and non-drive of these devices or members. Further, a member such as the fixing device 25 is subjected to the temperature control and therefore the temperature is determined by the control.

However, as described below, the calculation can be simply performed by taking predetermined conditions into consideration and in this embodiment, such a calculation method is employed.

The predetermined conditions are the following three conditions described in combination with their functions as follows.

The constants satisfy: $C_\tau >> C_1, C_2 \ldots C_n$. As a result, the temperature t can be represented by: $t=\tau+\delta$, wherein $\delta$ represents a temperature difference corresponding to the temperature increase by another heat source.

The heat sources are collectively regarded as n=1. As a result, the equation (5) is solved and is changed into an equation using exponential function.

The temperature behavior of the heat sources is simplified.

According to actual measurement, with respect to the temperature difference $\delta$ of the toner supply container 6, the behavior such that the temperature difference $\delta$ converges to a predetermined value by contamination of the drive or continuation of stop of the drive is observed. This is because the above-described respective heat sources have the same rough tendency such that the temperature becomes high during the printing operation and becomes low during stop of the printing operation although there is a small difference in behavior among the heat sources. The equation in solved state of the equation (5) is caused to converge to a first target temperature value during the printing operation and to a second target temperature value during the stop of the printing operation at associated convergent speeds, respectively, so that the behavior of the temperature t can be schematically represented. That is, the temperature t of the toner supply container 6 can be represented by formulas (equations) (6) and (7) below when the temperature of the toner supply container 6 at a desired time $s_1$ (sec) is $t_1$ ($=\tau+\delta_1$) (° C.), a temperature difference of at a time $s_2$ (sec) when the previous temperature calculation is made is $t_2$ ($=\tau+\delta_2$) (° C.), a target temperature during the printing operation is $t_i$ ($=\tau+\delta_i$) (° C.), a target temperature during the stop of the printing operation is $t_o$ ($=\tau+\delta_0$) (° C.), the convergent speed during the printing is $v_i$, and the convergent speed during the stop of the printing operation is $v_o$.

(During Printing Operation)

$$t_1=\tau+\delta_1=T+(\delta_2-\delta_i)\times\exp(-(s_1-s_2)/v_i)+\delta_i \quad (6)$$

(During stop of printing operation)

$$t_2=\tau+\delta_2=\tau+(\delta_2-\delta_0)\times\exp(-(s_1-s_2)/v_o)+\delta^i \quad (7)$$

The operation of the printer controller 300 is the substantially same as that along the flow chart of FIG. 6 except that $t^1$ is obtained by using the formulas (6) and (7) in place of the reading of t in the step S203 and then is used as t.

(Fifth Embodiment)

In this embodiment, in addition to Fourth Embodiment, the developing device temperature T is also estimated by the method as described in Fourth Embodiment.

With respect to the temperature of the developing device 1, in addition to passive temperature change as in the case of the toner supply container 6, there is a need to take into consideration self-temperature rise by the drive of the developing device 1 itself. Specifically, in the formula (6), the target temperature higher than $\delta^i$ may be set. There is also a need to set the divergent speeds suitable for various conditions of developing device 1 in the formulas (6) and (7). Here, particularly, attention should be given to a difference in temperature behavior of the developing device between a full-color mode and a single color (K: black) mode. With respect to the developing device temperature behavior, in the full-color mode, the developing devices for four colors exhibit roughly the same temperature behavior but in the single color (K) mode, the temperature behavior of each of the developing devices 1Y, 1M and 1C and the temperature behavior of the developing device 1K are different from each other. For this reason, it is preferable that the target temperature value of each of the developing devices 1Y, 1M and 1C and the target temperature value of the developing device 1K are set depending on the color mode. Further, depending on the color mode, the temperature behavior of the four developing devices 1 as a single heat source is different and therefore it is further preferable that different target temperature values are set depending on the color mode also in the temperature calculation of the toner supply container 6.

Incidentally, the present invention is not limited to the above-described First to Fifth Embodiments but may also employ the following parameters (1), (2) and (3) as the parameter associated with the supply amount of the supply toner.

(1) An integrated value of exposure time (exposure amount) for exposing the image bearing member to light during the printing operation.

(2) Toner density (concentration) of the two component developer.

(3) Deposition amount of the reference toner image obtained by developing the reference latent image.

These parameters may be used singly or in combination.

The image density is increased with increase of the exposure amount (parameter (1)). The image density is increased with increase of the toner density of the two component developer (parameter (2)).

The image density is increased with increase of the deposition amount of the reference toner image (parameter (3)).

Further, as the image forming condition, in addition to various conditions for forming the electrostatic latent image (such as the charge amount for permitting uniform charging of the image bearing member and the exposure amount for permitting the exposure of the image bearing member), it is also preferable that the following parameters (i) and (ii) are adjusted.

(i) Developing bias (including the AC component) applied to the developing device.

(ii) Transfer bias for permitting transfer of the toner image from the image bearing member onto the transfer medium.

The image density is increased by increasing the developing bias (parameter (i)). The image density is increased by increasing the transfer bias (parameter (ii)). These image forming conditions may be used singly or in combination.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 266473/2010 filed Nov. 30, 2010, which is hereby incorporated by reference.

What is claimed is:

1. An image forming apparatus comprising:

an image bearing member for carrying an electrostatic latent image;

a developing device, containing a developer including a toner and a carrier, for developing the electrostatic latent image carried on said image bearing member into a toner image with the developer;

a supplying device for supplying the toner to said developing device;

a first detecting portion for detecting information on a temperature of said developing device;

a second detecting portion for detecting information on a temperature of said supplying device; and a correcting portion for correcting, when detection results of said first and second detecting portions are different from each other, an image forming condition with an increase of a supply amount of said supplying device.

2. An image forming apparatus according to claim 1, wherein said correcting portion increases, when a detected value of said second detecting portion is larger than that of said first detecting portion, a potential difference between a developing bias and an image portion potential of said image bearing member with the increase of the supply amount of said supplying device.

3. An image forming apparatus according to claim 1, wherein said correcting portion increases, when a detected value of said second detecting portion is larger than that of said first detecting portion, a slope of a γ look-up table with the increase of the supply amount of said supplying device.

4. An image forming apparatus according to claim 1, wherein said correcting portion increases a correct amount of the image forming condition corrected per unit supply of said supplying device depending on an increase of a difference between a detected value of said first detecting portion and a detected value of said second detecting portion.

5. An image forming apparatus according to claim 1, further comprising a humidity detecting portion for detecting a humidity in a main assembly of said image forming apparatus, wherein said correcting portion corrects the image forming condition on the basis of a relative humidity of said developing device calculated based on a detected value of said humidity detecting portion and a detected value of said first detecting portion and on the basis of a relative humidity of said supplying device calculated based on a detected value of said humidity detecting portion and a detected value of said second detecting portion.

6. An image forming apparatus according to claim 1, wherein said correcting portion decreases, when a detected value of said second detecting portion is smaller than that of said first detecting portion, a potential difference between a developing bias and an image portion potential of said image bearing member with the increase of the supply amount of said supplying device.

7. An image forming apparatus according to claim 1, wherein said correcting portion decreases, when a detected value of said second detecting portion is smaller than that of said first detecting portion, a slope of a γ look-up table with the increase of the supply amount of said supplying device.

8. An image forming apparatus comprising:

an image bearing member for carrying an electrostatic latent image;

a developing device, containing a developer including a toner and a carrier, for developing the electrostatic latent image carried on said image bearing member into a toner image with the developer;

a supplying device for supplying the toner to said developing device; and a correcting portion for correcting, when temperatures in said developing device and in said supplying device are different from each other, an image forming condition with an increase of a supply amount of said supplying device on the basis of information correlated with temperatures of said developing device and said supplying device.

9. An image forming apparatus according to claim 8, further comprising a detecting portion for detecting the information correlated with the temperatures of said developing device and said supplying device, wherein said correcting portion increases, when the temperature in said supplying device is higher than the temperature in said developing device, a potential difference between a developing bias and an image portion potential of said image bearing member with the increase of the supply amount of said supplying device and on the basis of a detection results of said detecting portion.

10. An image forming apparatus according to claim 8, further comprising:

first temperature detecting means for detecting the temperature in said developing device; and second temperature detecting means for detecting the temperature in said supplying device, wherein said correcting portion decreases, when a detected value of said second temperature detecting means is smaller than that of said first temperature detecting means, a potential difference between a developing bias and an image portion potential of said image bearing member with the increase of the supply amount of said supplying device and on the basis of a detection results of said detecting portion.

11. An image forming apparatus comprising:

an image bearing member for carrying an electrostatic latent image;

a developing device, containing a developer including a toner and a carrier, for developing the electrostatic latent image carried on said image bearing member into a toner image with the developer;

a supplying device for supplying the toner to said developing device;

a supply amount detecting portion for detecting information on a supply amount of said supplying device;

a calculating portion for calculating a temperature in said developing device and a temperature in said supplying device; and a correcting portion for correcting, when temperatures of said developing device and said supplying device are different from each other, an image forming condition with an increase of a supply amount of said supplying device on the basis of information calculated by said calculating portion and on the basis of a detection result of said supply amount detecting portion.

* * * * *